US010549964B2

(12) United States Patent
Thelen et al.

(10) Patent No.: US 10,549,964 B2
(45) Date of Patent: Feb. 4, 2020

(54) MANUAL HOIST WITH AUTOMATIC SPEED CHANGE DEVICE

(71) Applicant: Columbus McKinnon Corporation, Getzville, NY (US)

(72) Inventors: Thomas Thelen, Wuppertal (DE); Brent Pope, Norwood, NC (US)

(73) Assignee: Columbus McKinnon Corporation, Getzville, NY (US)

( * ) Notice: Subject to any disclaimer, the term of this patent is extended or adjusted under 35 U.S.C. 154(b) by 78 days.

(21) Appl. No.: 15/983,422

(22) Filed: May 18, 2018

(65) Prior Publication Data

US 2019/0352151 A1 Nov. 21, 2019

(51) Int. Cl.

| | |
|---|---|
| ***B66D 1/22*** | (2006.01) |
| ***B66D 1/04*** | (2006.01) |
| ***B66D 3/16*** | (2006.01) |

(52) U.S. Cl.

CPC ..... *B66D 1/225* (2013.01); *B66D 1/04* (2013.01); *B66D 3/16* (2013.01)

(58) Field of Classification Search

CPC ... B66D 1/04; B66D 1/14; B66D 1/22; B66D 1/225; B66D 3/12; B66D 3/16

See application file for complete search history.

(56) References Cited

U.S. PATENT DOCUMENTS

| | | | | |
|---|---|---|---|---|
| 2,373,048 | A | 4/1945 | Parker et al. | |
| 2,403,462 | A | 7/1946 | Schroeder | |
| 3,369,795 | A | 2/1968 | Fujita | |
| 3,799,005 | A * | 3/1974 | Koehler | B66D 1/04 475/12 |
| 4,436,333 | A | 3/1984 | Tsuda | |
| 4,605,111 | A | 8/1986 | Ohno et al. | |
| 4,819,913 | A | 4/1989 | Nishimura | |
| 5,538,222 | A | 7/1996 | Kataoka | |
| 5,556,078 | A | 9/1996 | Kubota et al. | |
| 5,641,151 | A | 6/1997 | Kataoka | |
| 6,299,140 | B1 | 10/2001 | Kamljuk | |
| 6,406,001 | B1 | 6/2002 | Wada | |
| 6,517,054 | B2 | 2/2003 | Samejima | |
| 6,554,255 | B2 * | 4/2003 | Fujikawa | B66D 3/14 254/342 |
| 7,614,610 | B2 | 11/2009 | Xia et al. | |
| 9,561,940 | B2 | 2/2017 | Kasai | |
| 2013/0105751 | A1 * | 5/2013 | Xia | B66D 3/16 254/385 |

FOREIGN PATENT DOCUMENTS

| | | | |
|---|---|---|---|
| AU | 2011318873 | A1 | 1/2013 |
| DE | 19502233 | A2 | 5/1996 |
| DE | 112011103160 | | 7/2013 |
| JP | 8119586 | | 5/1996 |
| WO | 2012033087 | A1 | 3/2012 |

* cited by examiner

*Primary Examiner* — Sang K Kim

*Assistant Examiner* — Nathaniel L Adams

(74) *Attorney, Agent, or Firm* — Phillips Lytle LLP; David L. Principe

(57) ABSTRACT

A system for automatically switching between a high speed and a low speed state for rotating the drive shaft of a manual hoist.

17 Claims, 8 Drawing Sheets

MANUAL HOIST WITH AUTOMATIC SPEED CHANGE DEVICE

TECHNICAL FIELD

The present invention relates generally to a hoist with a built-in load sensitive automatic speed change device, and more specifically to a switching mechanism for use with a hand wheel.

BACKGROUND ART

A manual hoist typically includes a hand wheel. The hand wheel has grooves defined therein for receiving a chain that is used to manually turn the hand wheel which is connected to a drive shaft. The drive shaft is connected to a set of gears that multiplies the force on the hand wheel to provide for raising and lowering a heavy load supported on a load sprocket by a load chain. The load is connected to the load chain by an attachment device such as a hook. When there is no load applied to the load sprocket, it takes a long time to raise and lower the attachment device because of the gear ratio. Accordingly, there is a need for a device capable of reducing the amount of time required to move the attachment device on an unloaded or lightly loaded system.

BRIEF SUMMARY OF THE INVENTION

With parenthetical reference to the corresponding parts, portions or surfaces of the disclosed embodiment, merely for the purposes of illustration and not by way of limitation, the present invention meets the above described need by providing a manual hoist with an automatic speed change device.

The invention may provide a system for automatically switching between a high speed and a low speed state for rotating the drive shaft of a manual hoist. The system may comprise a hand wheel (10) having a central opening (13) defined therein. A hollow cylindrical tube (19) may surround the central opening (13) and extend therefrom.

A switching mechanism (31) may be attached to the tube (19) on the hand wheel (10). The switching mechanism (31) may have a central bore (44) defined therein. The switching mechanism (31) may be provided with a spring-biased ring (34) having a first plurality of teeth (37) disposed thereon.

A drive shaft (22) has a first end (25) sized to fit inside the cylindrical tube (19) on the hand wheel (10). The drive shaft (22) is configured to extend through the central opening (13) in the hand wheel (10) where it engages with the gear system and load sprocket of the manual hoist in a conventional manner. The drive shaft (22) has a second end (28) with a gear (40) fixedly attached thereto.

An irreversible lock (78) may be disposed in the switching mechanism (31). The irreversible lock (78) may be provided with an inner rotating part (81) and an outer ring (96). The inner rotating part (81) may be fixedly attached to the drive shaft (22). The inner rotating part (81) and outer ring (96) are capable of automatically switching between a first condition where the inner rotating part (81) and the outer ring (96) are mechanically coupled to rotate in unison, and a second position where the inner rotating part (81) rotates independently from the outer ring (96).

The invention may include a planetary gear system (63) having a ring gear (66), a plurality of planet gears (72), and a planetary carrier (75) attached to the planet gears (72). The planetary gears (72) may be configured to receive the gear (40) attached to the drive shaft in the position of a sun gear.

The planetary carrier (75) has a second plurality of teeth (60) configured to engage with the first plurality of teeth (37) on the switching mechanism (31).

When the system has a light load or no load attached thereto, the first plurality of teeth (37) on the switching mechanism (31) engage with the second plurality of teeth (60) on the planetary carrier (75) such that rotation of the hand wheel (10) by means of a chain rotates the planetary carrier (75). Rotation of the planetary carrier (75) may provide a roughly seven times faster rotation of the sun gear (40) based on the configuration of the planetary gear system (63). The faster rotation of the sun gear (40) causes the inner rotating part (81) connected to the drive shaft (22) to rotate independently of the outer ring (96). Accordingly, when there is a light or no load condition, the drive shaft (22) rotates much faster than the hand wheel (10) such that the attachment device on the hoist can be moved more rapidly.

When the system has a heavier load attached thereto, the first plurality of teeth (37) do not engage with the second plurality of teeth (60). In this state, the rotation of the hand wheel (10) rotates the outer ring (96) which is mechanically coupled to the inner rotating part (81) of the irreversible lock (78) to rotate in unison such that the hand wheel (10) and the drive shaft (22) rotate at the same speed in one to one relation corresponding to the normal operation of a manual hoist.

DESCRIPTION OF THE PREFERRED EMBODIMENTS

Figure 1:
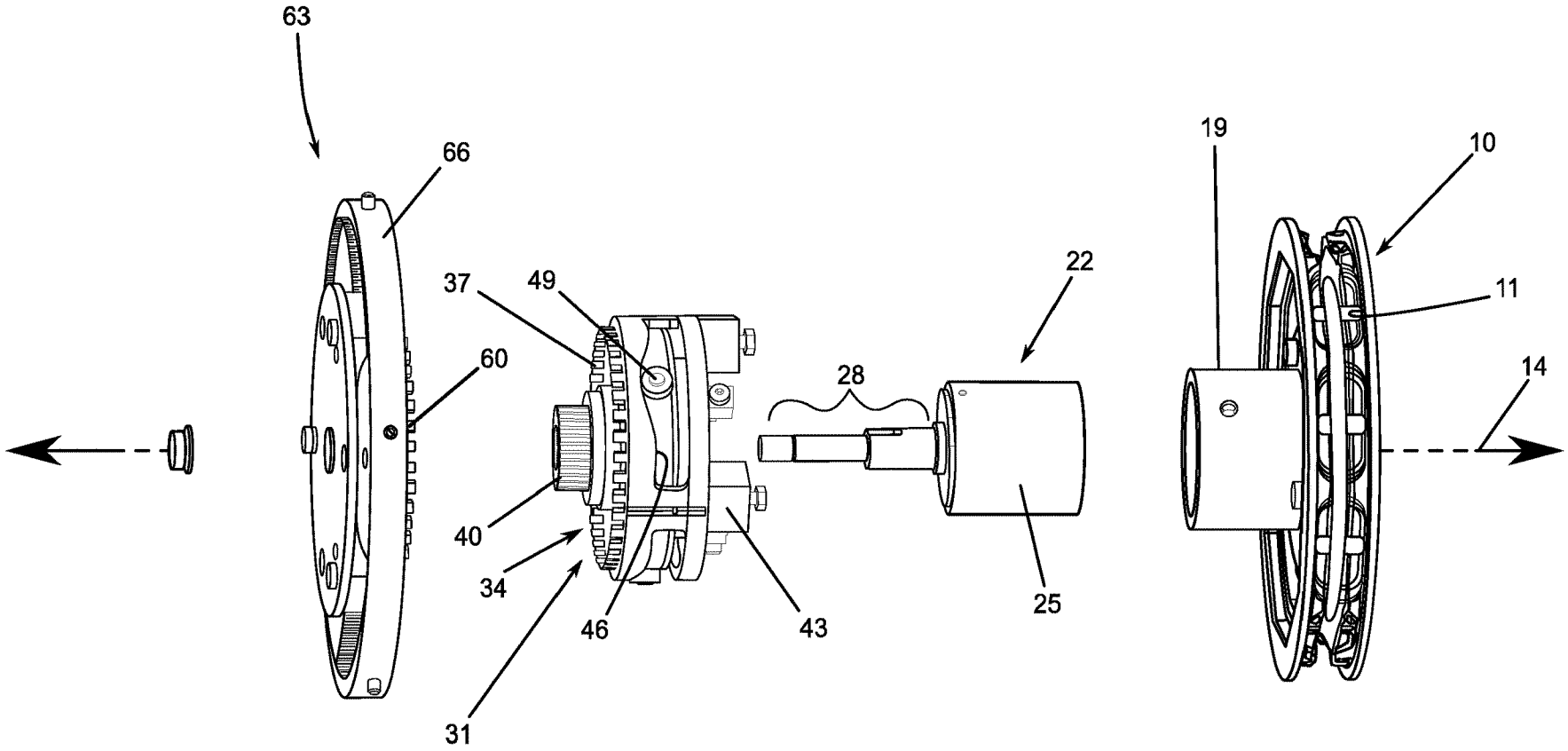
FIG. 1 is an exploded perspective view of the automatic speed change device of the present invention.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Referring to FIGS. 1-8, and initially to FIG. 1 thereof, the automatic speed changing device of the present invention may include a hand wheel 10. The hand wheel 10 has grooves 11 formed therein for receiving a chain (not shown) for manual rotation. The hand wheel 10 has a central opening 13 (FIG. 5) arranged along a longitudinal axis 14. The hand wheel 10 may be provided with a hollow, cylindrical tube 19 surrounding the central opening 13 and extending therefrom in the axial direction. A drive shaft 22 may be provided with a complex shape including a hollow cylindrical portion 25 connected to an elongate portion 28.

The system may be provided with a switching mechanism 31. The switching mechanism 31 may be provided with a ring 34 have a first plurality of teeth 37 extending in the axial direction. A body 43 of the switching mechanism 31 may have a race 46 defined therein for receiving a cam roller 49. The ring 34 may be biased in the axial direction away from the body 43 as will be described in greater detail herein. When the cam roller 49 is in the center position shown in the figure, the teeth 37 are extended a maximum distance in the axial direction to engage with a second plurality of teeth 60 on a planetary carrier 75 described in further detail below. When the cam roller 49 is rotated away from center in either direction, the position of the cam roller 49 in the race 46 causes the first plurality of teeth 37 to move in the axial direction away from a planetary gear system 63 as will be described in greater detail below. A gear 40 attaches to the elongate portion 28 of the drive shaft 22.

Figure 2:
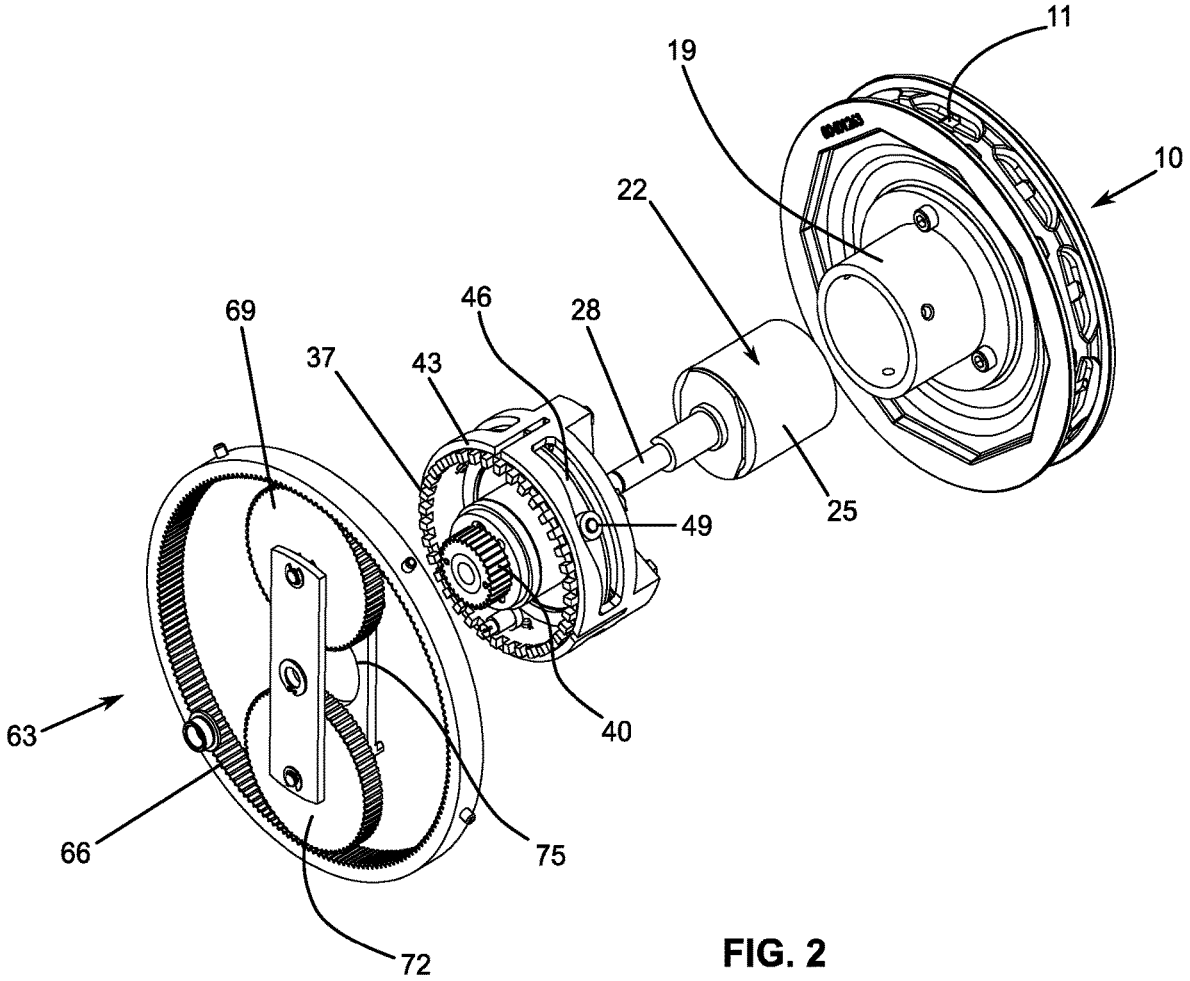
FIG. 2 is another exploded perspective view of the automatic speed change device of the present invention.

Turning to FIG. 2, a planetary gear system 63 includes a ring gear 66, and a pair of planet gears 69 and 72. Other configurations with different sizes and numbers of planetary gears will be evident to those of ordinary skill in the art based on this disclosure. A planetary carrier 75 attaches to the planet gears 69 and 72. The planetary gear system 63 is configured to receive gear 40 in the center of the system where it functions as the sun gear.

The driven inner rotating part 81 (best shown in FIG. 4) of an irreversible lock 78 is fixedly attached to the elongate portion 28 of shaft 22 as described in greater detail below.

Figure 3:
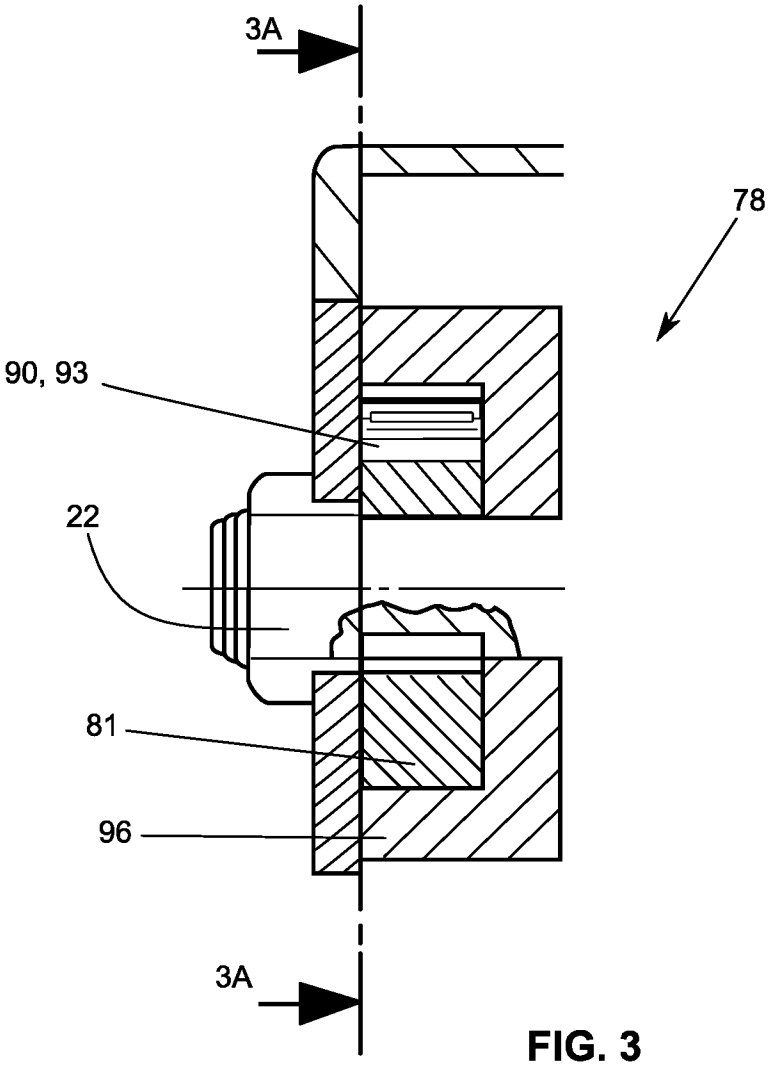
FIG. 3 is a partial cross-sectional view of the irreversible lock of the present invention.
Figure 3A:
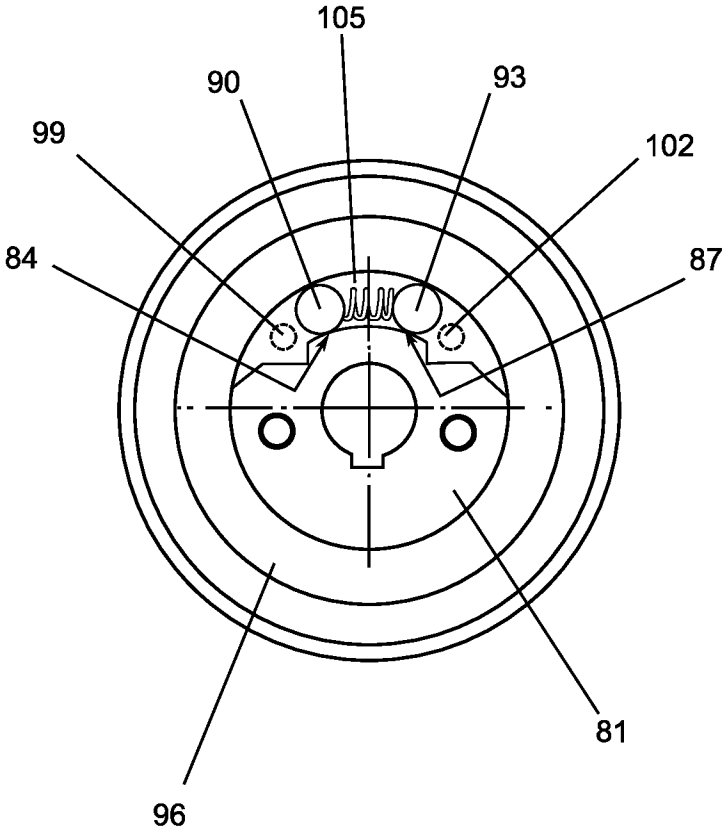
FIG. 3A is a cross-sectional view taken along lines 3A-3A of FIG. 3.

In FIGS. 3 and 3A, the irreversible lock 78 includes the inner rotating part 81 which is fixedly connected to the elongate portion 28 of the drive shaft 22. The inner rotating part 81 may be provided with one or more cut-out openings at its circumference where clamping surfaces 84 and 87 (FIG. 3A) are located for engaging with rolling bodies 90 and 93 which function as clamping bodies. At their ends, the clamping surfaces 84 and 87 come close to the cylindrical inner running surface of the other coupling element in the form of an outer ring 96 such that depending on the direction of rotation of the inner rotating part 81, a clamping effect is created by the clamping rollers 90 and 93 with the coupling outer ring 96. The outer ring 96 is mechanically coupled to the hand wheel 10. Two axially projecting control pins 99 and 102 engage into the cut-out openings in the inner rotating part 81. The two control pins 99 and 102 are positioned in such a way that the distance between them is somewhat greater than that of the two clamping rollers 90 and 93 when they exhibit their maximum outer position due to the spring 105 located between them.

The spring biased rollers 90 and 93 connect the outer ring 96 to the inner rotating part 81. This is the case if the sun gear 40 does not rotate faster than the outer ring 96. In this state, there is either no rotation at all or the teeth 60 on the planetary carrier 75 are not engaged with the teeth 37 on the switching mechanism 31.

If the sun gear 40 rotates faster than the outer ring 96 (which occurs when teeth 60 on planetary gear 75 are engaged with the teeth 37 on the switching mechanism), a pin 99 or 102 pushes one of the rollers 90, 93 out of position and the inner rotating part 81 with the attached output shaft 22 can rotate freely in that direction. In this state, the other roller rotates freely like a free wheel and the inner rotating part 81 and outer ring 96 rotate independently.

Figure 4:
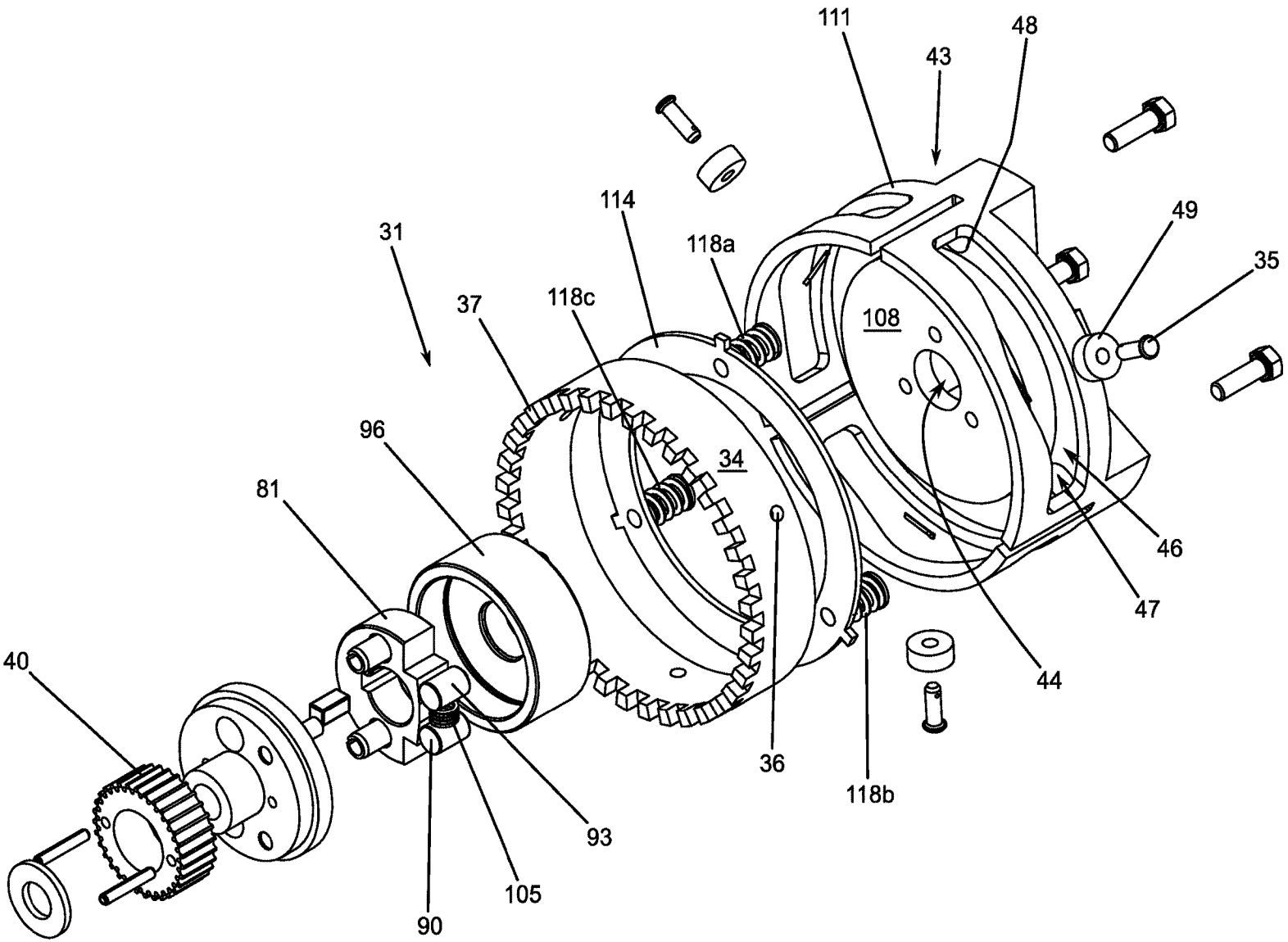
FIG. 4 is an exploded perspective view of the switching mechanism of the present invention.

In FIG. 4, the switching mechanism 31 is shown in greater detail. Body 43 is provided with an axial bore 44 for receiving the shaft 22 (FIG. 2). A lower surface 108 surrounds the bore 44. A cylindrical sidewall 111 extends in the axial direction. The race 46 is defined in the sidewall 111. A ring-shaped plate 114 fits inside the sidewall 111 and is biased in the axial direction by a plurality of coil springs 118*a-c*. The ring 34 with the first plurality of teeth 37 may be supported by the ring shaped plate 114. The cam roller 49 is attached to the ring 34 by means of a fastener 35 and an opening 36 in the ring 34, and the cam roller 49 is disposed inside the race 46. Accordingly, the ring 34 is spring biased in the axial direction and its axial position is controlled by the position of the cam roller 49 within the race 46. At the center of the race 46, the ring 34 is provided with its maximum extension away from the body 43 in the axial direction. At the opposed ends 47, 48 of the race 46, the ring 34 is positioned at its least extension in the same axial direction. The position at the center of the race 46 corresponds to the position where the first plurality of teeth 37 on the ring 34 engage with the second plurality of teeth 60 on the planetary carrier 75 (FIG. 2). In this position, the hand wheel 10 is driving the planetary carrier 75. The planetary carrier 75 may be configured in a 1:6.7 ratio with the sun gear 40. Other ratios and configurations of the planetary gears will be evident to those persons of ordinary skill in the art based on this disclosure. Accordingly, when the hand wheel 10 is turning the planetary carrier 75, the sun gear 40 is turning 6.7 times faster. This position corresponds to the light or no load state of the load on the manual hoist.

When the cam roller 49, is positioned toward the ends 47, 48 of the race 46 (which is caused by turning of the hand wheel 10 with a heavy load attached to the load chain of the manual hoist), the teeth 37 on the ring 34 are moved away from the teeth 60 in the axial direction. In this position, the hand wheel 10 is not turning the planetary carrier 75, and the hand wheel 10 turns the outer ring 96 of the irreversible lock 78. The outer ring 96 is coupled to the inner rotating part 81 and rotates in unison therewith in the low speed condition of the irreversible lock 78. The inner rotating part 81 is fixedly attached to the shaft 22. Accordingly, in the low speed condition, the hand wheel 10 is turning the shaft 22 in a one to one relationship corresponding to the normal operation of a manual hoist.

The outer ring 96 of the irreversible lock 78 is attached to the body 43 of the switching mechanism and turns with the handwheel 10. The ring 34 with the teeth 37 also turns with the handwheel 10. When the teeth 37 are engaged with the teeth 60 on the planetary carrier 75, the rotation of the planetary carrier 75 causes a fast rotation of the shaft 22 by means of the sun gear 40 which causes the inner rotating part 81 to automatically decouple from the outer ring 96 according to the operation of the irreversible lock 78.

Figure 5:
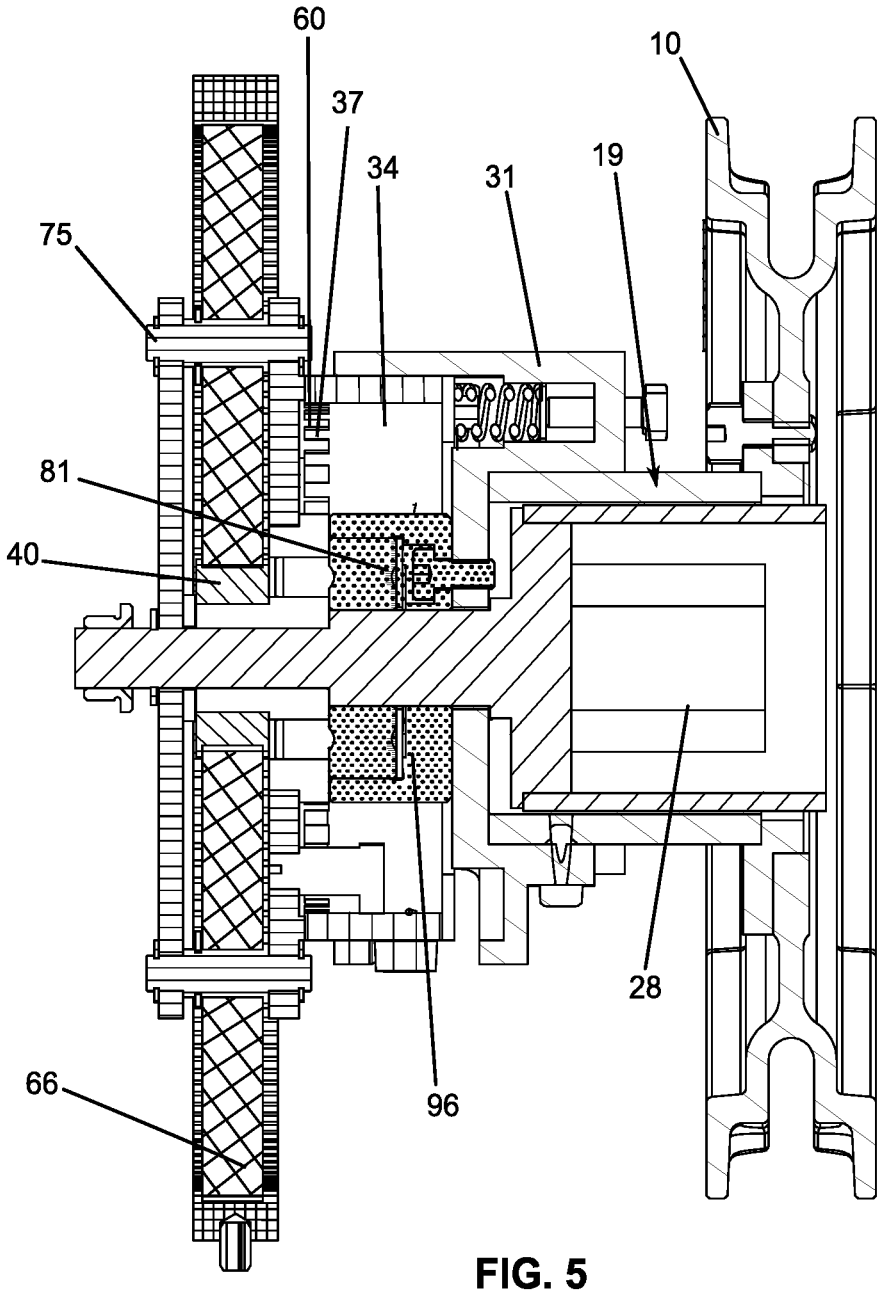
FIG. 5 is a sectional view of the automatic speed change device of the present invention.

In FIG. 5, a sectional view shows the connection between the hollow, cylindrical tube 19 on the hand wheel 10 to the switching mechanism 31. The outer ring 96 of the irreversible lock 78 is attached to the switching mechanism 31. The switching mechanism 31 also carries the ring 34 with the teeth 37. In FIG. 5, the teeth 37 are shown fully engaged with the teeth 60 on the planetary carrier 75. In this position, the inner rotating part 81 of the irreversible lock 78 rotates independently of the outer ring 96 and the connection of the inner part 81 to the elongate portion 28 of the drive shaft 22 causes the drive shaft to rotate at the speed of the sun gear 40 which is several times faster than the speed of rotation of the planetary carrier 75 which is being rotated by the hand wheel 10 through engagement of the teeth 37 with the teeth 60.

Figure 7:
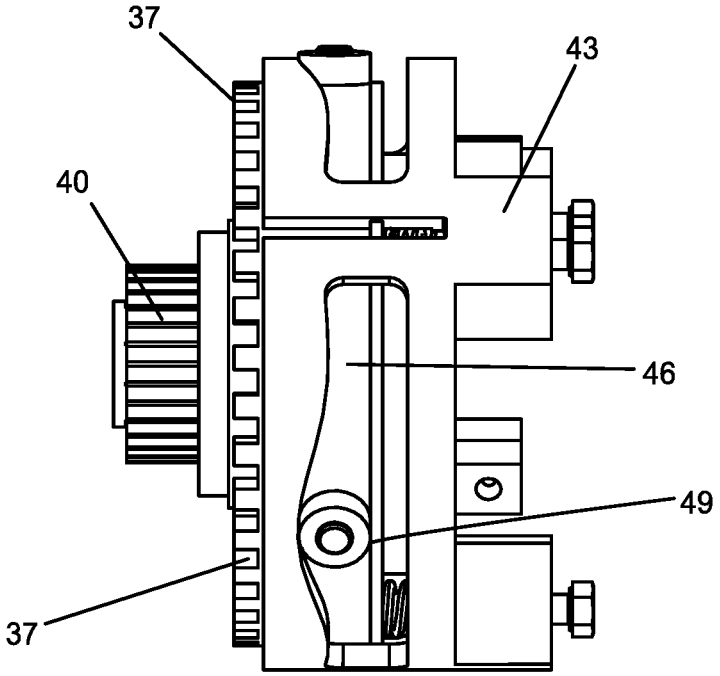
FIG. 7 is a side elevational view of the switching mechanism of the present invention.
Figure 6:
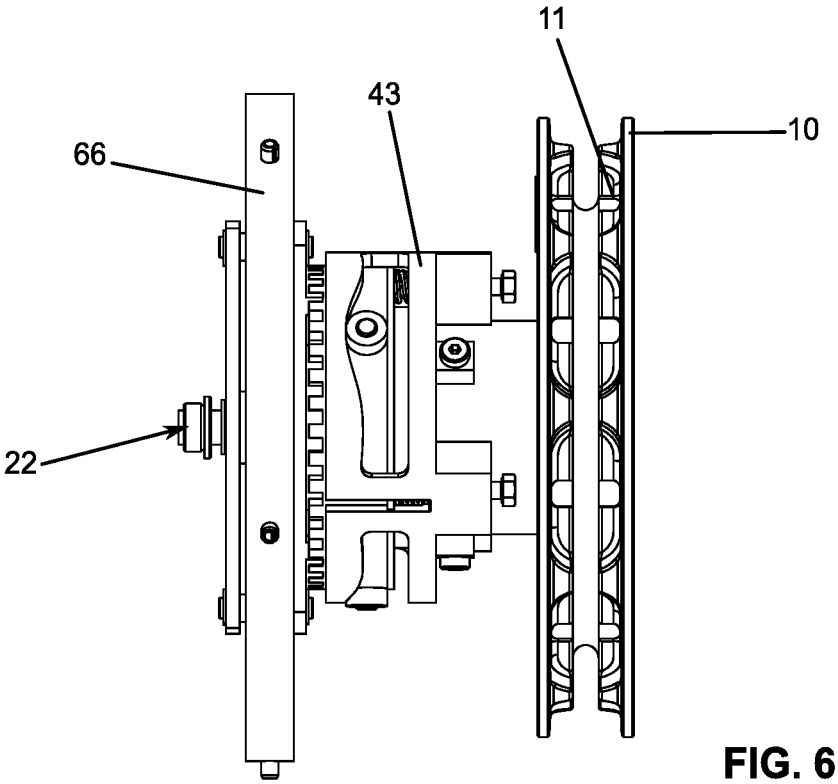
FIG. 6 is a side elevational view of the automatic speed change device of the present invention.
Figure 8:
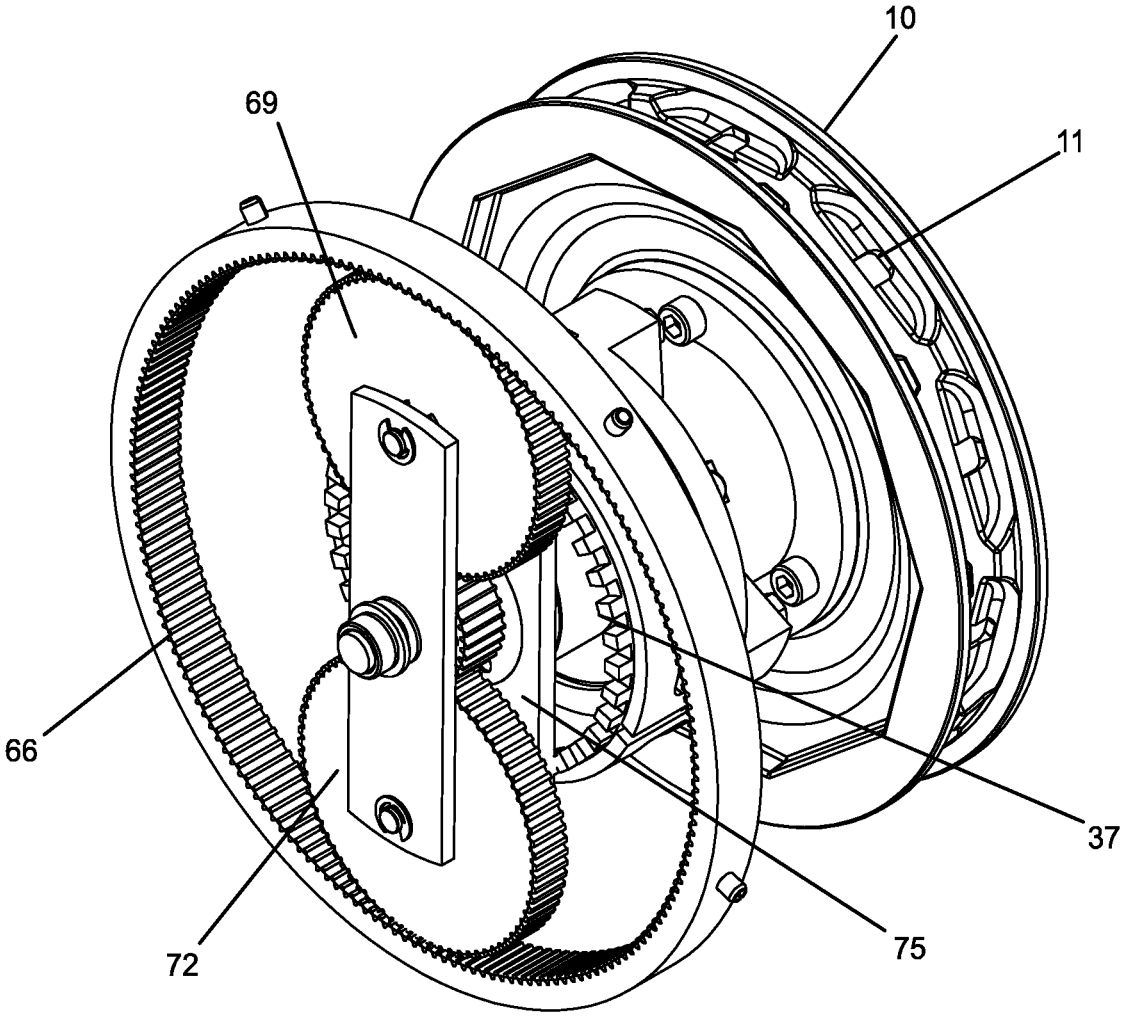
FIG. 8 is another perspective view of the automatic speed change device of the present invention.

FIG. 6 shows the connection of the switching mechanism 31 to the tube 19 extending from the hand wheel 10. In FIG. 7, the switching mechanism 31 is shown with the cam roller 49 in the center position in the race 46 where the teeth 37 are extending the maximum distance in the axial direction toward the planetary carrier 75. Sun gear 40 is shown in a position where it is configured for extending into the planetary gear system 63 to engage with the planet gears 69 and 72 as shown in FIG. 8.

The present invention contemplates that many changes and modifications may be made. Therefore, while the presently-preferred form of the automatic speed change device has been shown and described, and several modifications and alternatives discussed, persons skilled in this art will readily appreciate that various additional changes and modifications may be made without departing from the spirit of the invention, as defined and differentiated by the following claims.

The invention claimed is:

1. A system for automatically switching between a high speed and a low speed state for the drive shaft of a manual hoist, the drive shaft of the manual hoist being coupled to a load chain with an attachment for a load, the system comprising:

a hand wheel having a central opening defined therein defining a longitudinal axis;

a hollow cylindrical tube surrounding the central opening and extending therefrom in the axial direction;

a switching mechanism attached to the tube, the switching mechanism having a central bore defined therein, the switching mechanism having a ring with a first plurality of teeth disposed thereon, the ring being biased in the axial direction, the switching mechanism having an irreversible lock disposed thereon, the irreversible lock having an inner rotating part and an outer ring, the outer ring being mechanically coupled to the hand wheel such that rotation of the hand wheel causes the outer ring to rotate, the irreversible lock configured to switch between a first position where the inner rotating part and the outer ring are mechanically coupled to rotate together in unison and a second position where the inner rotating part rotates at a higher speed independently of the outer ring;

a drive shaft having a first end sized to fit inside the tube and having a second end disposed opposite the first end, the drive shaft having a portion sized to fit through the central bore of the switching mechanism, the second end of the drive shaft having a gear attached thereto, the drive shaft fixedly attached to the inner rotating part of the irreversible lock;

a planetary gear set having a ring gear, a plurality of planet gears and a planetary carrier attached to the planet gears, the planet gears configured to receive the gear on the drive shaft in the positon of a sun gear, the planetary carrier having a second plurality of teeth disposed thereon, the second plurality of teeth configured to receive the first plurality of teeth in driving engagement;

wherein when the system has a light or no load attached to the load chain, the first plurality of teeth on the switching mechanism engage with the second plurality of teeth on the planetary carrier such that rotation of the hand wheel causes the planetary carrier to rotate at the same speed as the hand wheel which in turn causes the sun gear to rotate faster than the hand wheel, the faster rotation of the sun gear causes the inner rotating part of the irreversible lock to rotate independently of the outer ring; and, wherein when the system has a heavier load attached to the load chain the first plurality of teeth do not engage with the second plurality of teeth and the hand wheel rotates the outer ring such that the hand wheel drives the drive shaft in a one to one relation.

2. The system of claim 1, wherein the hand wheel has a groove defined therein for receiving a chain.

3. The system of claim 1, wherein the hollow cylindrical tube is sized to receive a hollow cylindrical portion of the drive shaft.

4. The system of claim 1, wherein the switching mechanism has a body with a bottom surface and a side wall extending in the axial direction.

5. The system of claim 4, wherein the side wall has a race defined therein for receiving a cam.

6. The system of claim 5, wherein the ring has a cam attached thereto, the cam disposed in the race.

7. The system of claim 6, wherein a spring is disposed between the bottom of the ring and the bottom surface of the body of the switching mechanism such that the ring is biased away from the bottom surface in the axial direction.

8. The system of claim 1, wherein the irreversible lock is disposed on the switching mechanism inside the ring.

9. The system of claim 1, wherein the outer ring of the irreversible lock is coupled to the hand wheel via the switching mechanism.

10. The system of claim 1, wherein the plurality of planetary gears comprises two planetary gears.

11. The system of claim 1, wherein the plurality of planetary gears comprises two or more planetary gears.

12. The system of claim 1, wherein the sun gear rotates at a ratio of approximately 7 to 1 with respect to rotation of the planetary carrier.

13. The system of claim 1, wherein the inner rotating part of the irreversible lock has two cutout sections defining clamping surfaces.

14. The system of claim 13, wherein a pair of spring biased rollers are disposed on the clamping surfaces.

15. The system of claim 14, wherein the rollers create a clamping force on the inside wall of the outer ring when a pair of axial pins are in a first position.

16. The system of claim 14, wherein the rollers alternate between a first position where they clamp the inner rotating part to the outer ring and a second position where they allow independent rotation between the inner rotating part and the outer ring.

17. A system for automatically switching between a high speed and a low speed state for the drive shaft of a manual hoist, the drive shaft of the manual hoist being coupled to a load chain with an attachment for a load, the system comprising:

a hand wheel having a central opening defined therein defining a longitudinal axis;

a hollow cylindrical tube surrounding the central opening and extending therefrom in the axial direction;

a switching mechanism attached to the tube, the switching mechanism having a central bore defined therein, the switching mechanism having a ring with a first plurality of teeth disposed thereon, the ring being biased in the axial direction, the switching mechanism having a body with a sidewall having a race defined therein for receiving a cam, the ring having a cam attached thereto, the cam on the ring disposed inside the race, the switching mechanism having an irreversible lock disposed thereon inside the ring, the irreversible lock having an inner rotating part and an outer ring, the irreversible lock configured to switch between a first position where the inner rotating part and the outer ring are mechanically coupled to rotate together in unison and a second position where the inner rotating part rotates at a higher speed independently of the outer ring;

a drive shaft having a first end sized to fit inside the tube and having a second end disposed opposite the first end, the drive shaft having a portion sized to fit through the central bore of the switching mechanism, the second end of the drive shaft having a gear attached thereto, the drive shaft fixedly attached to the inner rotating part of the irreversible lock;

a planetary gear set having a ring gear, a plurality of planet gears and a planetary carrier attached to the planet gears, the planet gears configured to receive the gear on the drive shaft in the positon of a sun gear, the planetary carrier having a second plurality of teeth disposed thereon, the second plurality of teeth configured to receive the first plurality of teeth in driving engagement;

wherein the position of the cam in the race controls the engagement of the first plurality of teeth on the ring with the second plurality of teeth on the planetary carrier;

wherein when the system has a light or no load attached to the load chain, the cam is in a first position where the first plurality of teeth on the switching mechanism engage with the second plurality of teeth on the planetary carrier such that rotation of the hand wheel causes the planetary carrier to rotate at the same speed as the hand wheel which in turn causes the sun gear to rotate faster than the hand wheel, the faster rotation of the sun gear causes the inner rotating part of the irreversible lock to rotate independently of the outer ring; and, wherein when the system has a heavier load attached to the load chain, the cam is in a second position where the first plurality of teeth do not engage with the second plurality of teeth and the hand wheel rotates the outer ring which is mechanically coupled to and rotates in unison with the inner rotating part attached to the drive shaft such that the hand wheel drives the drive shaft in a one to one relation.

* * * * *